US009651008B2

(12) United States Patent
Adachi

(10) Patent No.: US 9,651,008 B2
(45) Date of Patent: May 16, 2017

(54) FUEL INJECTION VALVE

(71) Applicant: DENSO CORPORATION, Kariya, Aichi-pref. (JP)

(72) Inventor: Naofumi Adachi, Takahama (JP)

(73) Assignee: DENSO CORPORATION, Kariya (JP)

( * ) Notice: Subject to any disclaimer, the term of this patent is extended or adjusted under 35 U.S.C. 154(b) by 336 days.

(21) Appl. No.: 14/140,895

(22) Filed: Dec. 26, 2013

(65) Prior Publication Data

US 2014/0174405 A1 Jun. 26, 2014

(30) Foreign Application Priority Data

Dec. 26, 2012 (JP) ..... 2012-283498

(51) Int. Cl.

| | |
|---|---|
| ***F02M 51/06*** | (2006.01) |
| ***F02M 63/00*** | (2006.01) |
| ***F02M 47/02*** | (2006.01) |
| ***F02M 55/00*** | (2006.01) |
| *F02M 61/12* | (2006.01) |

(52) U.S. Cl.

CPC ..... *F02M 51/06* (2013.01); *F02M 47/027* (2013.01); *F02M 55/008* (2013.01); *F02M 63/0007* (2013.01); *F02M 63/0054* (2013.01); *F02M 61/12* (2013.01); *F02M 2547/001* (2013.01)

(58) Field of Classification Search

CPC ..... F02M 51/00; F02M 51/06; F02M 51/061; F02M 51/0646; F02M 51/0645; F02M 63/0007; F02M 55/008; F02M 47/027; F02M 63/0054

See application file for complete search history.

(56) References Cited

U.S. PATENT DOCUMENTS

| | | | | |
|---|---|---|---|---|
| 5,979,803 | A * | 11/1999 | Peters | F02M 47/046 239/533.2 |
| 2003/0089332 | A1 | 5/2003 | Yomogida | |
| 2010/0301143 | A1 * | 12/2010 | Adachi | F02M 47/02 239/533.3 |
| 2011/0198418 | A1 | 8/2011 | Kobane et al. | |

FOREIGN PATENT DOCUMENTS

| | | |
|---|---|---|
| JP | 2011-169242 | 9/2011 |

OTHER PUBLICATIONS

Office Action (2 pages) dated Dec. 2, 2014, issued in corresponding Japanese Application No. 2012-283498 and English translation (4 pages).

* cited by examiner

*Primary Examiner* — Jacob Amick
(74) *Attorney, Agent, or Firm* — Nixon & Vanderhye P.C.

(57) ABSTRACT

A sub out-orifice and an in-orifice are respectively formed in a low pressure passage and a high pressure passage of a fixed plate. A control valve is provided at an outlet port of the low pressure passage. In a normal control, the control valve starts its control-valve opening operation when a movable plate is in contact with the fixed plate. In an interval-shortening control, the control valve starts the control-valve opening operation at an earlier timing than that in the normal control, namely during a course in which a valve body is still in its valve-body closing operation.

5 Claims, 11 Drawing Sheets

DRIVE CURRENT
0

CONTROL VALVE
OPEN
CLOSE

CONTROL-CHAMBER PRESSURE
HIGH
LOW

MOVABLE PLATE
CLOSE
OPEN

VALVE BODY
OPEN
CLOSE

INJECTION RATE
0
t1
t2
t3
t4
t5
t6
TIME

NORMAL CONTROL
FIG. 5A START OF INJECTION
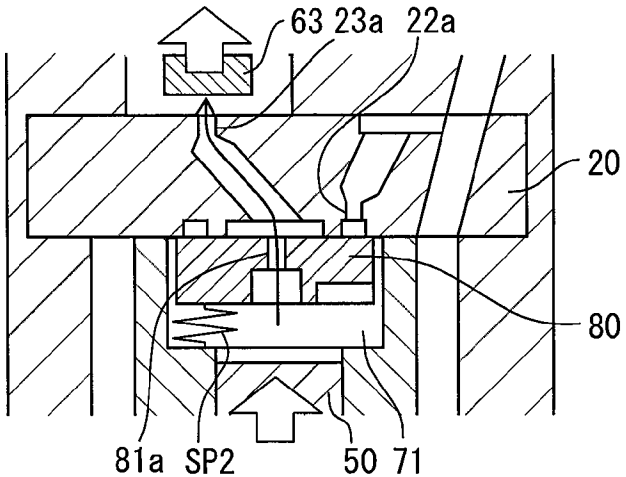
FIG. 5B TERMINATION OF INJECTION
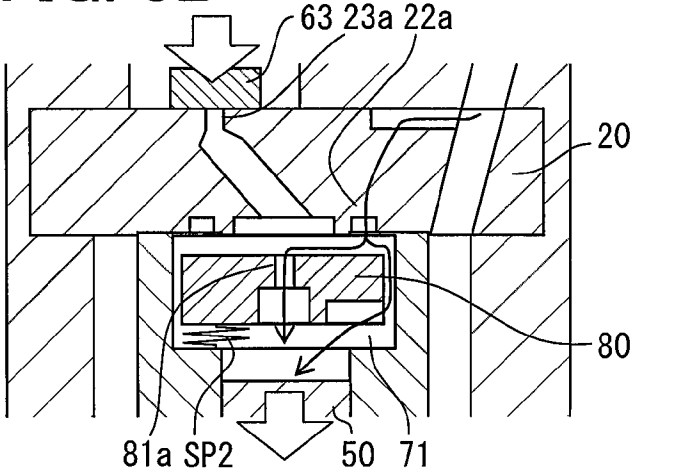
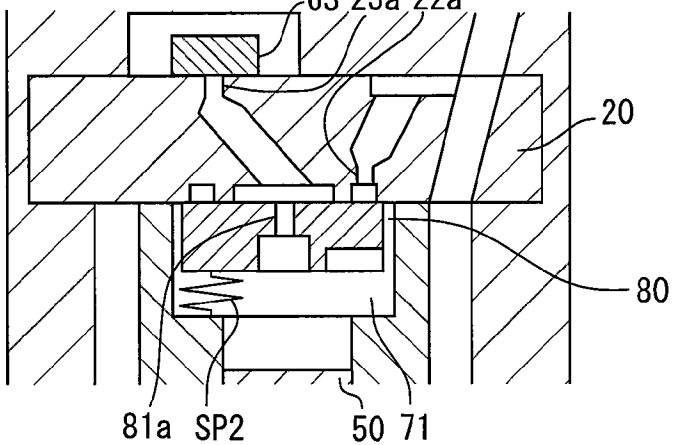
FIG. 5C INCREASE OF "Pcon"

INTERVAL-SHORTENING CONTROL
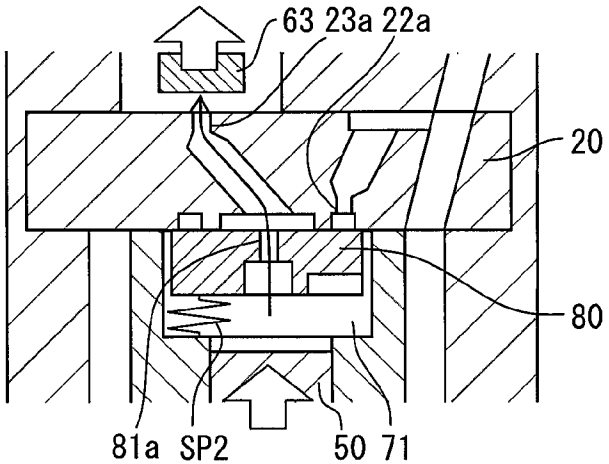
FIG. 6A START OF INJECTION
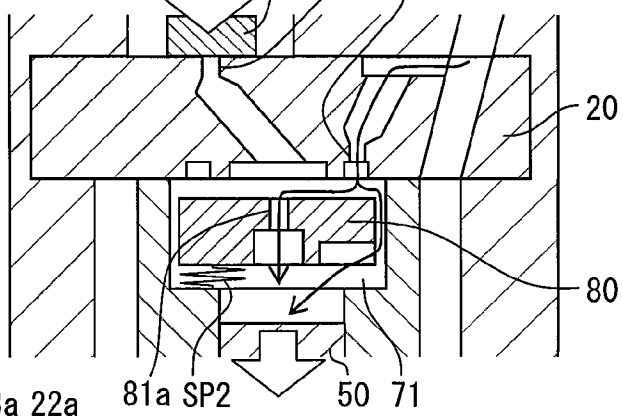
FIG. 6B TERMINATION OF INJECTION
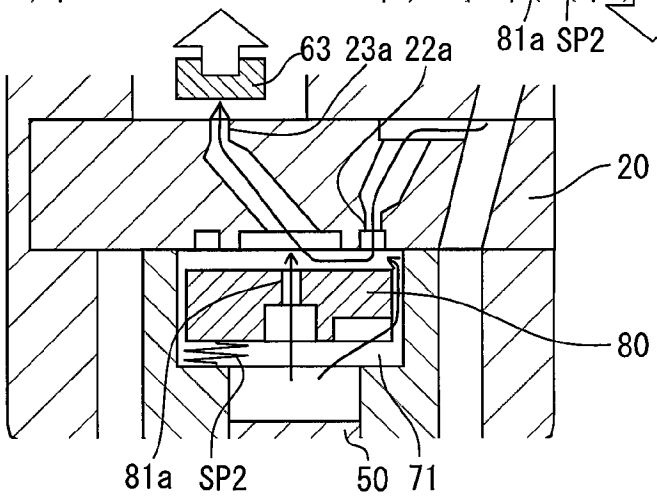
FIG. 6C DECREASE OF "Pcon"

$$\frac{Qin}{Qsub} = \sqrt{\frac{kpo}{1 - kpo}}$$

$$\frac{Qin}{Qsub} = 2.5 \sqrt{\frac{kpo}{1 - kpo}}$$

FUEL INJECTION VALVE

CROSS REFERENCE TO RELATED APPLICATION

This application is based on Japanese Patent Application No. 2012-283498 filed on Dec. 26, 2012 the disclosure of which is incorporated herein by reference.

FIELD OF TECHNOLOGY

The present disclosure relates to a fuel injection valve used in a fuel injection system for injecting fuel into an internal combustion engine.

BACKGROUND

A fuel injection valve of this kind generally has such a structure, according to which fuel pressure in a pressure control chamber (control-chamber pressure) is controlled so as to operate a valve body, which opens or closes an injection port for injecting fuel. Namely, the control-chamber pressure biases the valve body in a valve-body closing direction. The valve body is moved in a valve-body opening direction when the control-chamber pressure is decreased, while the valve body is moved in the valve-body closing direction when the control-chamber pressure is increased.

The fuel injection valve of this kind is known in the art, for example, as disclosed in the following Japanese Patent Publications:

Japanese Patent Publication No. 2011-169241
Japanese Patent Publication No. 2011-169242
Japanese Patent Publication No. 2011-012670

According to the fuel injection valve of the above prior art, a fixed plate and a movable plate are provided in order to rapidly increase the control-chamber pressure and thereby to improve response for a valve-body closing operation (response for terminating fuel injection). A high pressure passage for supplying high pressure fuel to the pressure control chamber and a low pressure passage for discharging the fuel from the pressure control chamber are formed in the fixed plate.

The movable plate is movably accommodated in the pressure control chamber. The movable plate is moved in a direction away from the fixed plate so as to open the high pressure passage, when a plate-separating force becomes larger than a plate-contacting force. The plate-separating force is a force for pushing the movable plate by fuel pressure away from the fixed plate, which acts on an upper end surface of the movable plate on a side to the fixed plate. The plate-contacting force is a force for pushing the movable plate by fuel pressure (or by fuel pressure and a spring force) toward the fixed plate, which acts on a lower end surface of the movable plate on a side opposite to the fixed plate. On the other hand, the movable plate is moved in the direction to the fixed plate so as to be in contact with the fixed plate and to close the high pressure passage, when the plate-contacting force is larger than the plate-separating force.

When starting fuel injection, a control valve provided at an outlet port of the low pressure passage is opened in a condition that the movable plate is in contact with the fixed plate. Then, the fuel is discharged from the pressure control chamber through the low pressure passage in a condition that the fuel supply from the high pressure passage is blocked off. As a result, the fuel pressure in the pressure control chamber is decreased, so that the valve body is moved to a valve-body opening position to start the fuel injection.

When terminating the fuel injection, on the other hand, the control valve is closed in the condition that the movable plate is in contact with the fixed plate. Then, the movable plate is separated from the fixed plate to thereby open the high pressure passage. As a result, the high pressure fuel is supplied to the pressure control chamber to increase the fuel pressure in the pressure control chamber, so that the valve body is moved to a valve-body closing position to terminate the fuel injection.

In case of a fuel injection valve, in which the movable plate is not provided, the fuel is constantly supplied from the high pressure passage to the pressure control chamber. Therefore, when a diameter of an orifice provided in the high pressure passage is made larger, the fuel pressure in the pressure control chamber is not rapidly decreased when the control valve is opened. As a result, response for starting the fuel injection is getting worse. On the other hand, when the diameter of the orifice is made smaller, the fuel pressure in the pressure control chamber is not rapidly increased when the control valve is closed. Then, response for terminating the fuel injection is getting worse.

Contrary to that, in case of the fuel injection valve of the above prior arts, in which the movable plate is provided, the high pressure passage is closed by the movable plate when the control valve is opened. As a result, when the diameter of the orifice provided in the high pressure passage is made larger, the response for starting the fuel injection is not adversely affected, while the response for terminating the fuel injection can be improved.

In a case that fuel is injected at multiple timings in one combustion cycle, a demand for reducing an interval between fuel injections (hereinafter, the injection interval) is increased. In order to meet the above demand, it is necessary to decrease the control-chamber pressure for carrying out a next fuel injection immediately after having terminated the previous fuel injection. The termination of the fuel injection is carried out by closing the control valve to thereby increase the control-chamber pressure. In other words, it is required that the control-chamber pressure, which has been increased for the purpose of terminating the fuel injection, is rapidly decreased to a valve-body opening pressure (that is, a control-chamber pressure at which the valve body starts its valve-body opening movement).

However, there exists a response delay between change of the control-chamber pressure and an actual opening or closing operation of the valve body. Therefore, due to the response delay, there exists a limit for shortening the injection interval from a timing of the termination of the fuel injection to a timing at which the control-chamber pressure is decreased to the valve-body opening pressure by opening the control valve.

According to the structure of the fuel injection valve disclosed in any one of the above prior arts, the movable plate is in a condition separated from the fixed plate at a time point at which the control valve is closed for the purpose of terminating the fuel injection. It is, therefore, necessary to wait until the movable plate is brought into contact with the fixed plate, in order to open the control valve for the purpose of starting the next fuel injection. The above waiting time for the movement of the movable plate to a plate-contacted condition acts as a drag for shortening the injection interval.

SUMMARY OF THE DISCLOSURE

The present disclosure is made in view of the above problem. It is an object of the present disclosure to provide a fuel injection valve, according to which an injection interval between fuel injections can be reduced.

According to a feature of the present disclosure, a fuel injection valve has;

a valve body movably accommodated in a nozzle body for opening or closing an injection port;

a pressure control chamber for applying control-chamber pressure to the valve body in a valve-body closing direction;

a fixed plate having a high pressure passage for supplying high pressure fuel to the pressure control chamber so as to move the valve body in the valve-body closing direction, the fixed plate also having a low pressure passage for discharging fuel out of the pressure control chamber so as to move the valve body in a valve-body opening direction;

a movable plate movably accommodated in the pressure control chamber, the movable plate being brought into contact with the fixed plate so as to block off communication between the high pressure passage and the pressure control chamber or the movable plate being separated from the fixed plate so as to communicate the high pressure passage to the pressure control chamber, and the movable plate having a through-hole for communicating the pressure control chamber to the low pressure passage; and a control valve for opening or closing an outlet port of the low pressure passage.

The fuel injection valve further has;

an injection-stop control portion for controlling a control-valve closing operation of the control valve in order to increase the control-chamber pressure and to thereby move the valve body to a valve-body closing position, so that fuel injection is terminated; and an interval-shortening control portion for starting a control-valve opening operation for the control valve even in a condition that the movable plate is still being separated from the fixed plate, when the control-chamber pressure is decreased in order to open the valve body so that fuel injection is carried out.

In addition, a sub out-orifice is formed in the low pressure passage for restricting flow rate of the fuel discharged from the pressure control chamber, while an in-orifice is formed in the high pressure passage for restricting flow rate of the fuel supplied into the pressure control chamber. The flow rate of the sub out-orifice and the flow rate of the in-orifice are so set that the control-chamber pressure is decreased when the control valve starts the control-valve opening operation by the interval-shortening control portion.

According to the present disclosure, since the control-valve opening operation for the control valve is started by the interval-shortening control portion in the condition that the movable plate is separated from the fixed plate, the fuel is discharged from the pressure control chamber via the low pressure passage before the movable plate is brought into contact with the fixed plate by the control-valve closing operation of the injection-stop control portion. In this operation, the high pressure fuel is supplied from the high pressure passage into the pressure control chamber, while the fuel is discharged from the pressure control chamber via the low pressure passage. In the condition that the fuel discharge and the fuel supply are carried out at the same time, the flow rate of the sub out-orifice and the flow rate of the in-orifice are so set that the control-chamber pressure is decreased when the control valve starts the control-valve opening operation by the interval-shortening control portion.

It is, therefore, possible to decrease the control-chamber pressure in advance before the movable plate is brought into contact with the fixed plate. In other words, the control-chamber pressure is decreased to a value close to a valve-body opening pressure (but not below the valve-body opening pressure) by an injection starting time of the next fuel injection. It is, thereby, possible to make preparations so as to bring the control-chamber pressure immediately before the fuel injection to the value close to the valve-body opening pressure. As a result, it is possible to smoothly carry out the next fuel injection, without being influenced by a response delay of the control-chamber pressure or by a waiting time for waiting until the movable plate is brought into contact with the fixed plate. As above, a fuel injection interval among multiple injections can be shortened.

In summary, the flow rate of the sub out-orifice and the flow rate of the in-orifice are so set that the control-chamber pressure is decreased when the control valve starts the control-valve opening operation in the condition that the movable plate is separated from the fixed plate. In addition, the control valve is opened before the movable plate is brought into contact with the fixed plate. Namely, the waiting time for the movable plate until the movable plate is brought into contact with the fixed plate can be used for a pressure decreasing time for the control-chamber pressure.

BRIEF DESCRIPTION OF THE DRAWINGS

The above and other objects, features and advantages of the present disclosure will become more apparent from the following detailed description made with reference to the accompanying drawings. In the drawings:

FIGS. 5A to 5C are schematic explanatory views for explaining a valve-body closing operation of a normal control in the first embodiment;

FIGS. 6A to 6C are schematic explanatory views for explaining a valve-body closing operation of an interval shortening control in the first embodiment;

DETAILED DESCRIPTION OF THE EMBODIMENTS

Figure 1:
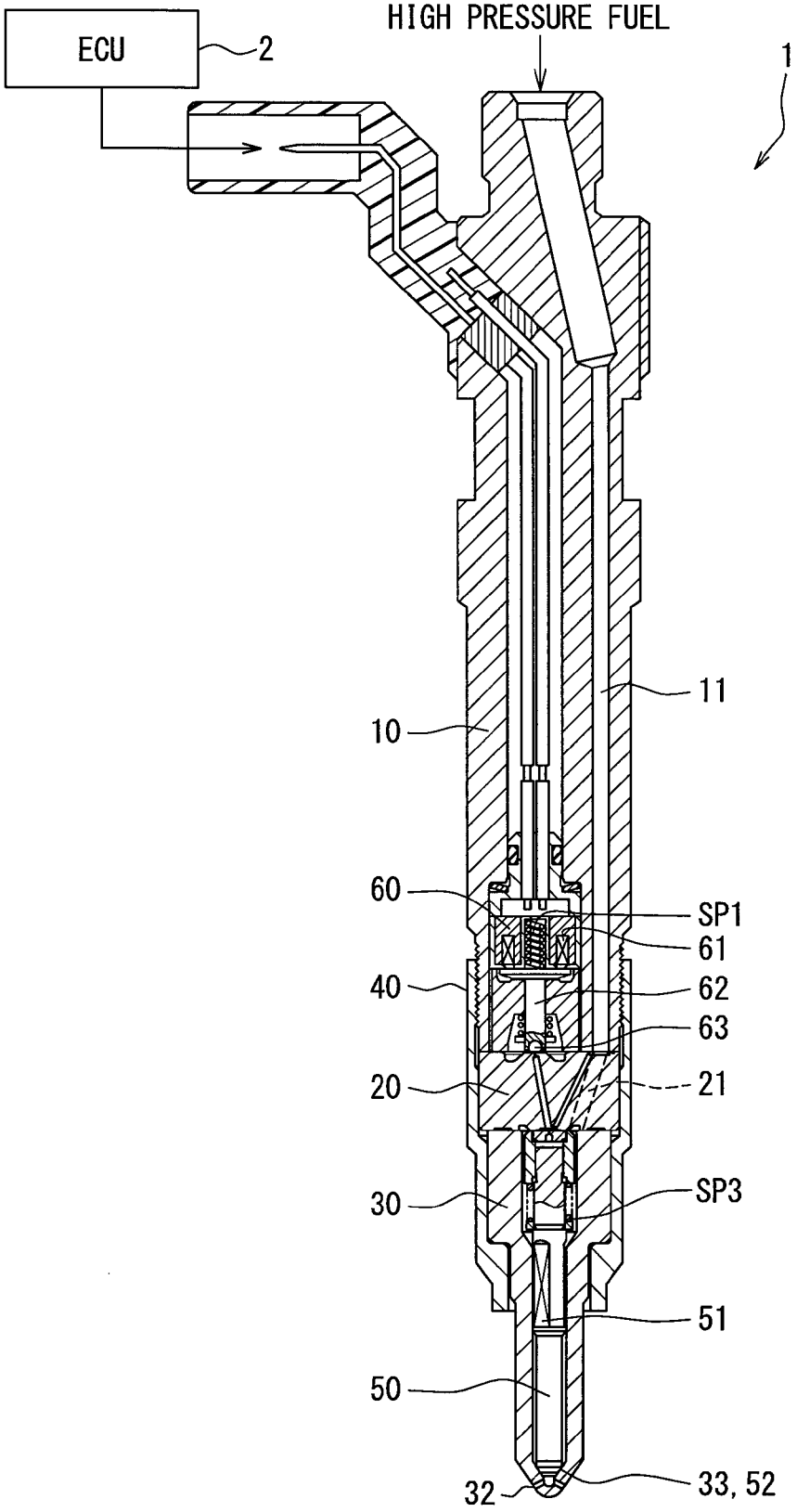
FIG. 1 is a schematic cross sectional view showing a fuel injection valve according to a first embodiment of the present disclosure.

The present disclosure will be explained hereinafter by way of multiple embodiments, in which a fuel injection valve is applied to an internal combustion engine (hereinafter, the engine) mounted in a vehicle. The engine in each of the embodiments is, for example, a compression-ignition type engine, such as a diesel engine. The same reference numerals are given to the same or similar portions and/or structures throughout the embodiments, for the purpose of eliminating repeated explanation.

First Embodiment

FIGS. 1 to 4 shows a fuel injection system, according to which a single injection (not multi-stage injection) is carried out.

A fuel injection valve 1 shown in FIG. 1 is operated by a drive current outputted from an electronic control unit 2 (hereinafter, the ECU 2). The ECU 2 calculates a target injection amount based on engine load "L", engine rotational speed "NE" and so on. The ECU 2 calculates an injection time period, which corresponds to the target injection amount, depending on pressure of high-pressure fuel to be supplied to the fuel injection valve 1. The ECU 2 calculates a power-supply time period depending on the above calculated injection time period, wherein a delay time for starting fuel injection as well as a delay time for terminating the fuel injection is taken into consideration. Then, the drive current is supplied to the fuel injection valve 1 during the power-supply time period.

The fuel injection valve 1 is composed of a holder 10 made of metal, a fixed plate 20 and a nozzle body 30, wherein the fixed plate 20 and the nozzle body 30 are assembled to the holder 10 by a retaining nut 40. Hereinafter, the holder 10, the fixed plate 20 and the nozzle body 30 are collectively referred to as an injection body.

A needle 50 (a valve body) is movably accommodated in the nozzle body 30. Injection ports 32 are formed at a forward end of the nozzle body 30 in order to inject high pressure fuel. When a valve body surface 52 formed in the needle 50 is separated from a valve seat surface 33 formed in the nozzle body 30, the injection ports 32 are opened so as to inject the fuel. On the other hand, when the needle 50 is seated on the valve seat surface 33, the injection ports 32 are closed so as to terminate the fuel injection.

High pressure fluid paths 11, 21, 31 and 51 are formed in the injection body (10, 20, 30) in order to introduce the high pressure fuel to the injection ports 32. The high pressure fuel is supplied to the fuel injection valve 1 from an outside component, that is, a common rail (a pressure accumulating device; not shown). The high pressure fluid paths 11, 21, 31 and 51 are formed in each of the holder 10, the fixed plate 20 and the nozzle body 30. The high pressure fluid path 51 is a fluid path formed between the nozzle body 30 and the needle 50.

Figures 4A, 4B, 4C, 4D, 4E, 4F:
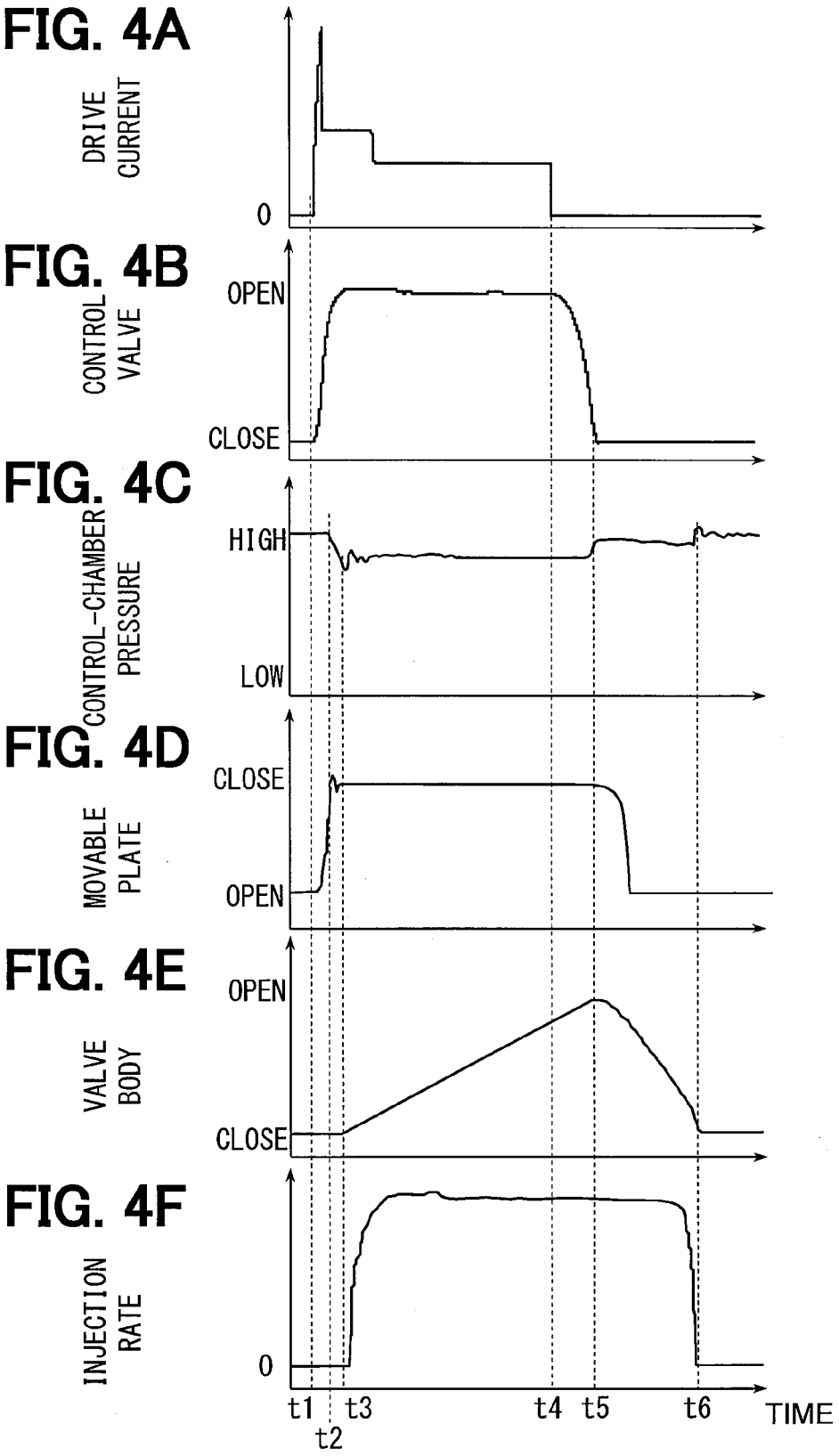
FIGS. 4A to 4F are time charts for explaining operation of the fuel injection valve of the first embodiment.

An electric actuator 60 having a solenoid coil 61 or a piezoelectric element is provided in the holder 10. The electric actuator 60 shown in FIG. 1 has the solenoid coil 61, a piston 62, a control valve 63 and a spring SP1. When the drive current is supplied to the solenoid coil 61 to generate electromagnetic force, the piston 62 is attracted by the electromagnetic force and the control valve 63 is moved to a control-valve opening position (as shown in FIG. 4A and FIG. 4B). When the power supply to the solenoid coil 61 is cut off, the piston 62 is pushed down by a spring force of the spring SP1 so that the control valve 63 is moved to a control-valve closing position.

Figure 2:
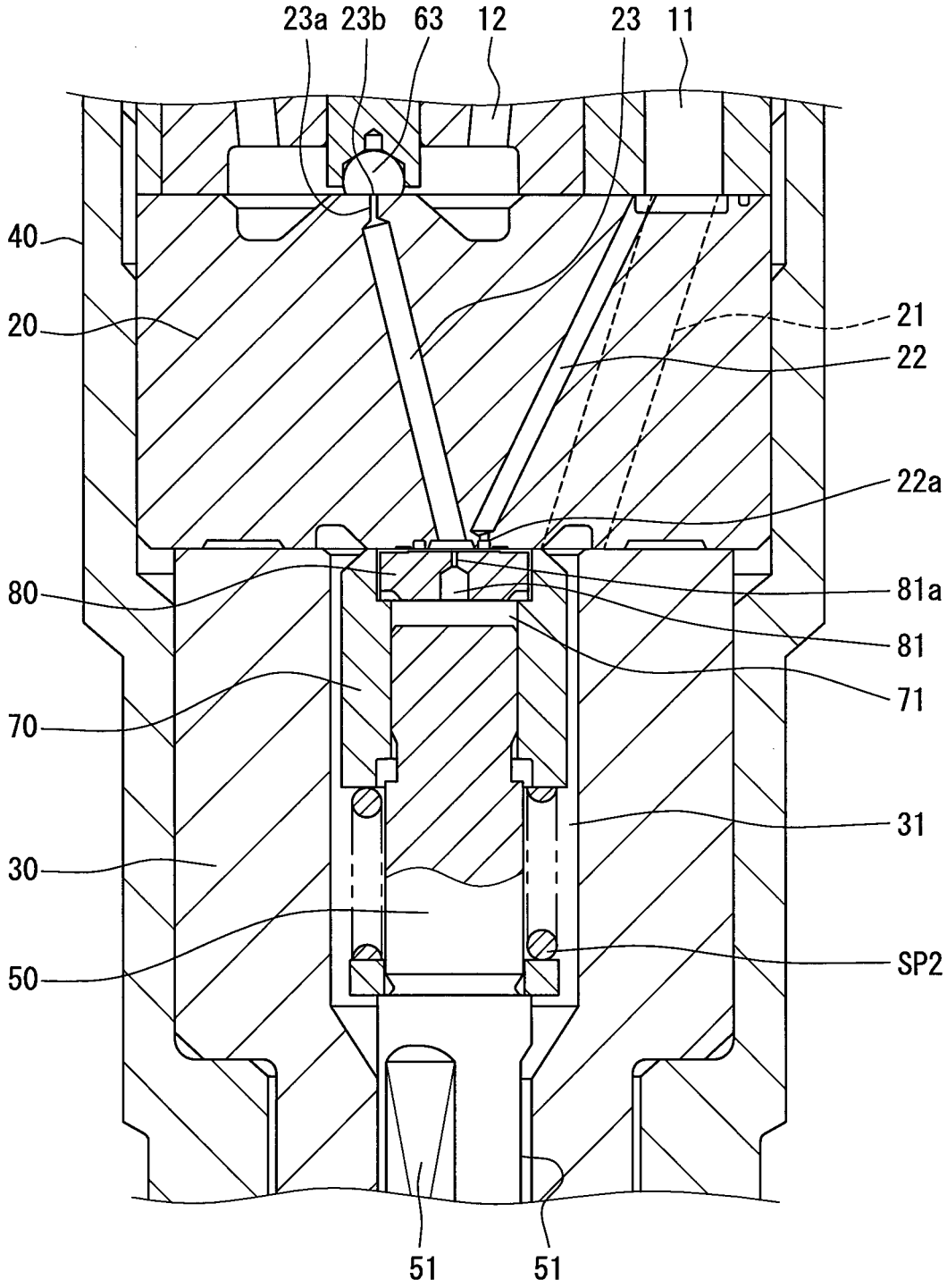
FIG. 2 is a schematically enlarged cross sectional view showing relevant portions of the fuel injection valve of FIG. 1.

As shown in FIG. 2, a cylindrical member 70 is fixed to a lower end surface of the fixed plate 20. An upper end portion of the needle 50 is movably inserted into the cylindrical member 70, so that the needle 50 can be moved in an upward direction and in a downward direction. The upward direction is an axial direction of the fuel injection valve 1 toward an opposite side of the injection ports 32, while the downward direction is the axial direction of the fuel injection valve 1 toward the injection ports 32.

A space surrounded by an inner peripheral wall of the cylindrical member 70, the lower end surface of the fixed plate 20 and an upper end surface of the needle 50 forms a pressure control chamber 71. A high pressure passage 22 for supplying the high pressure fuel into the pressure control chamber 71 and a low pressure passage 23 for discharging the fuel from the pressure control chamber 71 are formed in the fixed plate 20. An orifice 23*a* (a sub out-orifice) for restricting fuel flow is formed at a downstream side of the low pressure passage 23. An outlet port 23*b* of the low pressure passage 23 is opened or closed by the control valve 63. The high pressure passage 22 is bifurcated from the high pressure fluid paths 11 and 21. An orifice 22*a* (an in-orifice) for restricting fuel flow is formed at a downstream side of the high pressure passage 22.

Figure 3:
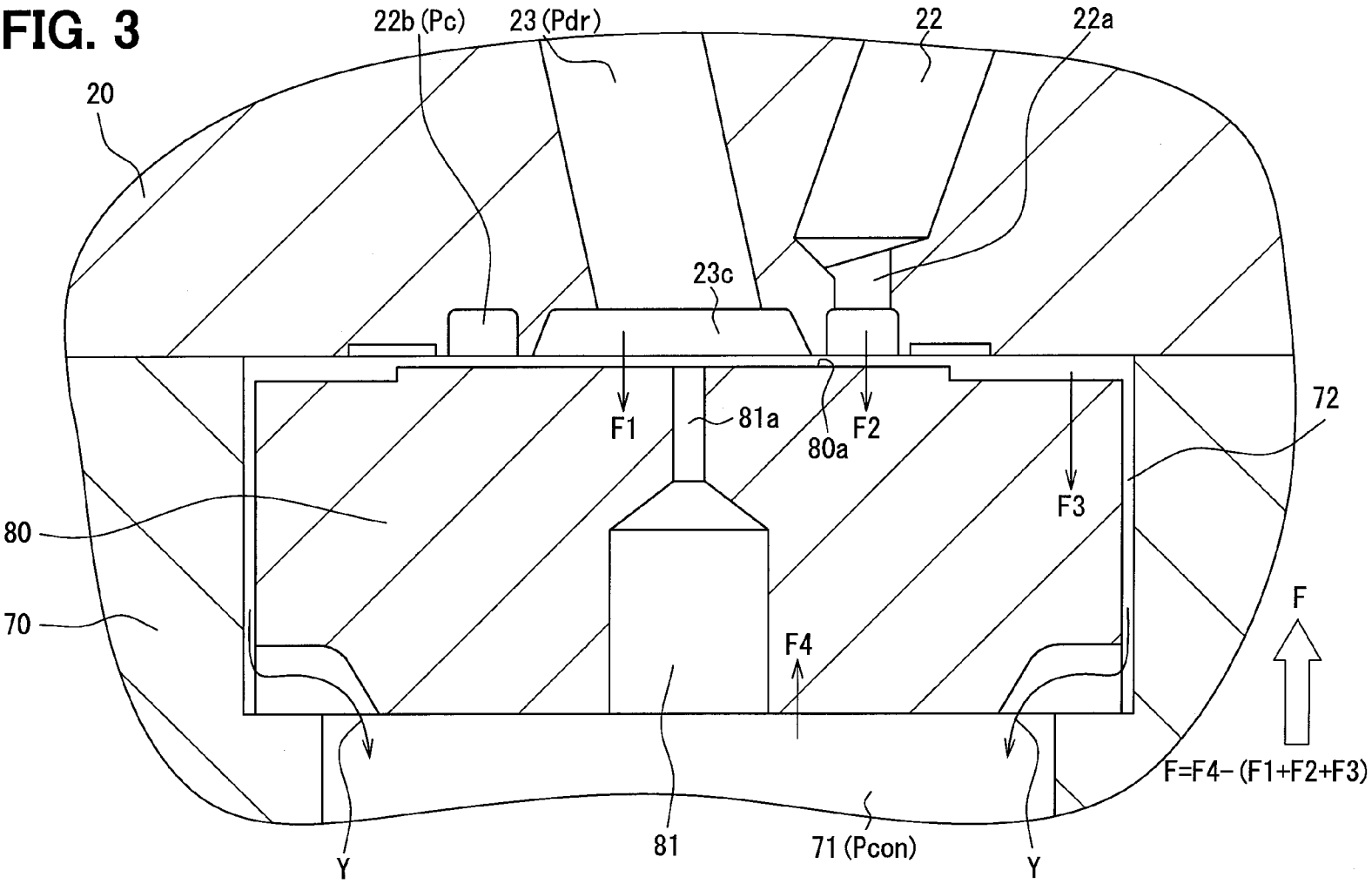
FIG. 3 is a schematically enlarged cross sectional view showing further relevant portions of the fuel injection valve of FIG. 2.

As shown in FIG. 3, a movable plate 80 of a disc shape is movably accommodated in the pressure control chamber 71, so that the movable plate 80 is movable in the upward and downward direction. When an upper end surface 80*a* of the movable plate 80 is brought into contact with the lower end surface of the fixed plate 20, a high pressure port 22*b* (which is an outlet port of the high pressure passage 22) is closed. FIG. 3 shows a condition of the movable plate 80, which is separated from the lower end surface of the fixed plate 20 and thereby the high pressure port 22*b* is opened.

A through-hole 81 is formed in the movable plate 80 in order to communicate a low pressure port 23*c* (which is an inlet port of the low pressure passage 23) and the pressure control chamber 71 with each other. An orifice 81*a* (an out-orifice) for restricting fuel flow is formed at a downstream side of the through-hole 81 (at an upper side of the movable plate 80). According to the above structure, the pressure control chamber 71 is continuously communicated to the low pressure passage 23, even when the movable plate 80 is brought into contact with the fixed plate 20 to close the high pressure port 22*b*. The low pressure port 23*c* is formed in a circular shape at a center of the lower end surface of the fixed plate 20. The high pressure port 22*b*, which is formed at a downstream side of the orifice 22*a*, is formed in an annular shape at the lower end surface of the fixed plate 20 so as to surround the low pressure port 23*c*.

A gap 72, which is formed between an outer peripheral wall of the movable plate 80 and an inner peripheral wall of the cylindrical member 70, has a function as a fuel passage so that the high pressure fuel in the high pressure passage 22 flows into the pressure control chamber 71 through the gap 72. When the movable plate 80 moves in the downward direction to open the high pressure port 22*b*, the high pressure fuel flows from the high pressure passage 22 into a lower portion of the pressure control chamber 71 through the gap 72, as indicated by arrows Y in FIG. 3.

In FIG. 3, "Pc" is a pressure in the high pressure passage 22, which is the pressure of the fuel to be supplied to the fuel injection valve 1 and which corresponds to a pressure of the common rail (not shown) for accumulating the fuel and distributing the fuel to respective fuel injection valves. "Pcon" in FIG. 3 is a pressure in the pressure control chamber 71 (a control-chamber pressure). More exactly, "Pcon" is a pressure in the lower portion of the pressure control chamber 71 on a side of the movable plate 80 closer to the injection port 32. "Pdr" in FIG. 3 is a pressure in the low pressure passage 23, wherein "Pc">"Pcon">"Pdr".

In addition, in FIG. 3, "F1" is a force, which the upper end surface of the movable plate 80 receives by the pressure "Pdr" of the low pressure port 23*c* in a plate-contacted condition (in which the movable plate 80 is in contact with the fixed plate 20). "F2" is a force, which the upper end surface of the movable plate 80 receives by the pressure "Pc" of the high pressure port 22*b* in the plate-contacted condition. "F3" is a force, which a part of the upper end surface of the movable plate 80 (which is not in contact with the fixed plate 20) receives by the pressure "Pcon" of the pressure control chamber 71. "F4" is a force, which the lower end surface of the movable plate 80 receives by the pressure "Pcon" of the pressure control chamber 71.

Therefore, when a total force of "F1", "F2" and "F3" in the plate-contacted condition of the movable plate 80 is smaller than the force "F4", a force "F" of an upward direction is applied to the movable plate 80, so that the plate-contacted condition is maintained. On the other hand, when the total force of "F1", "F2" and "F3" becomes larger than the force of "F4", that is, when "F1+F2+F3">"F4", the movable plate 80 is separated from the fixed plate 20.

Namely, in a condition that the needle 50 (the valve body 50) closes the injection ports 32 and the movable plate 80 is in contact with the fixed plate 20, when the control valve 63 is closed and thereby the control pressure "Pcon" and the low pressure "Pdr" are increased, the total force of "F1+F2+F3" becomes larger than the force of "F4". Then, the movable plate 80 is separated from the fixed plate 20. The fuel of the high pressure "Pc" flows from the high pressure port 22*b* into the pressure control chamber 71 through the gap 72. The control pressure "Pcon" in the pressure control chamber 71 is thereby rapidly increased. As a result, the needle 50 (the valve body 50) is pushed down by the control pressure "Pcon" to the valve seat surface 33, to hold a valve-body closing condition.

An operation of the fuel injection depending on the drive current to the fuel injection valve 1 from the ECU 2 will be explained with reference to FIGS. 4A to 4F and FIGS. 5A to 5C. FIGS. 4A to 4F show the operation of the fuel injection valve 1 shown in FIGS. 1 to 3. FIGS. 5A to 5C are cross sectional views for schematically showing the fuel injection valve 1 shown in FIGS. 1 to 3, in which a spring SP2 is provided. In the drawings (FIGS. 5A to 5C), arrows show direction of the fuel flow.

When the drive current is supplied from the ECU 2 to the solenoid coil 61 at a timing "t1" as shown in FIG. 4A in order to open the control valve 63, the low pressure passage 23 is communicated to a low pressure fluid path 12 (FIG. 2) so that the fuel in the pressure control chamber 71 starts fuel discharge to an outside of the fuel injection valve 1 via the low pressure passage 23 and the low pressure fluid path 12. At first, the fuel discharge decreases the fuel pressure in a space between the upper end surface 80*a* of the movable plate 80 and the lower end surface of the fixed plate 20 (that is, the fuel pressure at the low pressure port 23*c*). The movable plate 80 starts its upward movement depending on the decrease of the fuel pressure and the movable plate 80 is brought into contact with the fixed plate 20 at a timing "t2" as shown in FIG. 4D. Namely, the movable plate 80 closes the high pressure port 22*b* to thereby block off the communication between the high pressure passage 22 and the pressure control chamber 71 as shown in FIG. 5A.

Then, the fuel pressure in the pressure control chamber 71 is rapidly decreased, so that the needle 50 (the valve body 50) is lifted up at a high speed in a direction toward the pressure control chamber 71. In other words, the needle 50 starts its upward movement (the displacement) at a timing "t3" as shown in FIG. 4E. During a period (between "t3" and "t5") in which the needle 50 is displaced, the fuel pressure in the pressure control chamber 71 is maintained at almost a constant value, because of a volume reduction of the pressure control chamber 71.

When the power supply of the drive current is thereafter cut off by the ECU 2 in order to start a control-valve closing movement of the control valve 63 at a timing "t4" as shown in FIG. 4A, the fuel discharge through the low pressure passage 23 is terminated at a timing "t5" as shown in FIG. 4B. The termination of the fuel discharge increases at first the fuel pressure in the space between the upper end surface 80*a* of the movable plate 80 and the lower end surface of the fixed plate 20 (that is, the fuel pressure in the low pressure port 23*c*). The force "F1" is thereby increased so that the total force of "F1+F2+F3" for pushing down the movable plate 80 is increased.

As a result, the total force "F1+F2+F3" becomes larger than the force "F4", that is, "F1+F2+F3">"F4", the movable plate 80 which has been in the plate-contacted condition is going to be separated from the fixed plate 20 at the timing "t5" as shown in FIG. 4D. More exactly, the movable plate 80 opens the high pressure port 22*b* to thereby communicate the high pressure passage 22 to the pressure control chamber 71 as shown in FIG. 5B. Then, the fuel pressure in the pressure control chamber 71 (the control-chamber pressure "Pcon") is rapidly increased to push down the needle 50 at a high speed. The needle 50 is seated on the valve seat surface 33 at a timing "t6" as shown in FIG. 4E. Namely, the needle 50 (the valve body 50) is moved to the valve-body closing condition.

Since the volume of the pressure control chamber 71 is no longer increased after the needle 50 is seated on the valve seat surface 33, the control-chamber pressure "Pcon" is increased at the timing "t6" of FIG. 4C. Then, the force "F4" for lifting up the movable plate 80 is increased, so that the movable plate 80 is moved upwardly and brought into contact with the fixed plate 20 as shown in FIG. 5C. In the example shown in FIGS. 5A to 5C, the spring SP2 is provided at the lower end surface of the movable plate 80, so that a spring force of the spring SP2 biases the movable plate 80 in the upward direction to the fixed plate 20.

The above operation (in FIGS. 4A to 4F and FIGS. 5A to 5C) corresponds to an operation for a normal control, in which an interval between the fuel injections (the injection interval) is sufficiently long, as explained below. In other words, in the normal control operation, a waiting time period from the condition of FIG. 5B (in which the control valve 63 is closed to terminate the fuel injection) to the condition of FIG. 5A (in which the control valve 63 is opened to start the fuel injection) is sufficiently long. As a result, the control-chamber pressure "Pcon" can be increased within the waiting time period and the movable plate 80 can be moved to the plate-contacted position as shown in FIG. 5C. Namely, the movable plate 80 is brought into contact with the fixed plate 20, that is, a condition ready for starting the next fuel injection.

In a case that a target time (the target value) for the injection interval is shorter than a predetermined time, the following process for shortening the injection interval is carried out.

An operation for starting the fuel injection shown in FIG. 6A as well as an operation for terminating the fuel injection shown in FIG. 6B is the same to those for the normal control shown in FIGS. 5A and 5B. However, in the control operation for shortening the injection interval, the control valve 63 is opened within the waiting time period in advance before the fuel injection, as shown in FIG. 6C. According to such operation, the high pressure fuel from the high pressure passage 22 flows into the low pressure passage 23. An orifice diameter of the sub out-orifice 23*a* as well as an orifice diameter of the in-orifice 22*a* is so decided that the control-chamber pressure "Pcon" is decreased in the above condition of FIG. 6C but not decreased to a valve-body opening pressure "PO" during the waiting time period. The valve-body opening pressure "PO" corresponds to control-chamber pressure "Pcon", at which the valve body 50 (the needle 50) starts its valve-body opening movement. In the condition of FIG. 6C, a part of the fuel flows out from the pressure control chamber 71 into the low pressure passage 23 through the through-hole 81 and the gap 72. The condition of FIG. 6C is also referred to as a waiting condition.

When a ratio "Qin/Qsub" is extremely large in the waiting condition of FIG. 6C (during the waiting time period), the control-chamber pressure "Pcon" is increased, wherein "Qin" is a flow rate of the fuel to be supplied into the pressure control chamber 71 via the in-orifice 22*a* and "Qsub" is a flow rate of the fuel to be discharged from the pressure control chamber 71 via the sub out-orifice 23*a*. On the other hand, when the ratio "Qin/Qsub" is extremely small, the control-chamber pressure "Pcon" is decreased to the valve-body opening pressure "PO" during the waiting time period.

In view of the above points, the above ratio "Qin/Qsub" is so decided that the control-chamber pressure "Pcon" (steady pressure) in a steady-state situation coincides with the valve-body opening pressure "PO". The steady-state situation is a situation that fuel discharging amount via the sub out-orifice 23*a* and fuel supplying amount via the in-orifice 22*a* are stable.

More exactly, the ratio "Qin/Qsub" is calculated in accordance with the following formulas 1 to 7, wherein the following symbols respectively designate the following meanings:

"Cin"=flow rate coefficient of the in-orifice 22*a;*

"Sin"=cross sectional area of the in-orifice 22*a;*

"Qin"=flow rate of the in-orifice 22*a;*

"Csub"=flow rate coefficient of the sub out-orifice 23*a;*

"Ssub"=cross sectional area of the sub out-orifice 23*a;*

"Qsub"=flow rate of the sub out-orifice 23*a;*

Figure 7:
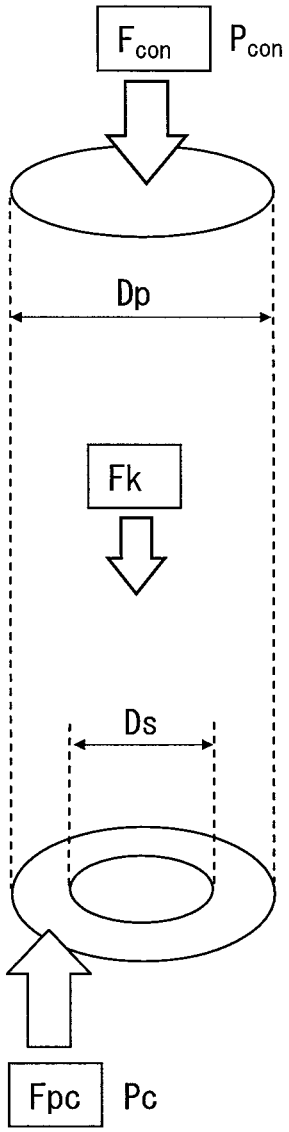
FIG. 7 is an explanatory view for explaining mathematical formula for setting orifice diameters.

"Pcon"=the control-chamber pressure in the condition that the control valve 63 is opened and the movable plate 80 is separated from the fixed plate 20;

"Pc"=fuel pressure in the common rail (the rail pressure);

"kpo"=coefficient for the valve-body opening pressure (=PO/Pc);

"Dp"=piston diameter (diameter of the valve body 50);

"Ds"=seat diameter;

"Fk"=spring load for the spring SP2 (FIG. 7);

"Fpc"=force biased in a valve-body opening direction, which is applied to the valve body 50 by the rail pressure "Pc" at the valve body surface 52 in the valve-body closing condition (FIG. 7); and "Fcon"=force applied to the valve body 50 by the control-chamber pressure "Pcon" in the valve-body closing direction (FIG. 7).

Each of the above flow rates of "Qin" and "Qsub" corresponds to the flow rate in the steady-state situation. More exactly, experiments are carried out, in which fuel of a predetermined pressure (for example, 10 MPa) is applied to each of the orifices 22*a* and 23*a*, in order to measure flow rates for the respective orifices. And such experimental values are used for the flow rates of "Qin" and "Qsub".

The following formula 1 shows equation of continuity based on a premise that fuel flow-in amount and fuel flow-out amount for the pressure control chamber 71 coincide with each other in the steady-state condition. A left-hand side of the formula 1 is the fuel flow-in amount, while a right-hand side is the fuel flow-out amount.

$$Cin \cdot \mathrm{Sin}\sqrt{\frac{2(Pc - Pcon)}{\rho}} = Csub \cdot Ssub\sqrt{\frac{2Pcon}{\rho}} \quad \text{[Formula 1]}$$

When the formula 1 is rearranged by "Pcon", the following formula 2 is obtained:

$$Pcon = \frac{Cin^2 \cdot \mathrm{Sin}^2}{Csub^2 \cdot Ssub^2 + Cin^2 \cdot \mathrm{Sin}^2} Pc \quad \text{[Formula 2]}$$

It is necessary to make "Pcon" of the formula 2 to be "PO", in order that the control-chamber pressure "Pcon" is controlled at the valve-body opening pressure "PO". When the formula 2 is rearranged by "kpo (=PO/Pc)", the following formula 3 is obtained:

$$kpo \cdot Pc = \frac{Cin^2 \cdot \mathrm{Sin}^2}{Csub^2 \cdot Ssub^2 + Cin^2 \cdot \mathrm{Sin}^2} Pc \quad \text{[Formula 3]}$$

When "Cin·Sin" is expressed by "Qin" and "Csub·Ssub" is expressed by "Qsub", and the formula 3 is rearranged by "Qin" and "Qsub", the following formula 4 is obtained:

$$\frac{Qin}{Qsub} = \sqrt{\frac{kpo}{1 - kpo}} \quad \text{[Formula 4]}$$

As above, the ratio "Qin/Qsub" can be expressed by "kpo", which is a ratio of the valve-body opening pressure "PO" with respect to the rail pressure "Pc". Now, the "kpo" is calculated by the following formulas 5 to 7. The following formula 5 shows that a valve-body opening force "Fpc" (a left-hand side of the formula 5) applied to the valve body 50 is equal to a valve-body closing force "Fcon+Fk" (a right-hand side of the formula 5), immediately before the valve body 50 is opened.

$$Fpc = Fcon + Fk \quad \text{[Formula 5]}$$

"Fpc" is obtained for the product of an area, which is calculated by subtracting an area for the seat diameter "Ds" from an area for the piston diameter "Dp", and the rail pressure "Pc". "Fcon" is obtained for the product of the area for the piston diameter "Dp" and the valve-body opening pressure "PO (=Pc)". Accordingly, the formula 5 is converted to the following formula 6.

$$\frac{\pi(Dp^2 - Ds^2)}{4} Pc = kpo\frac{\pi Dp^2}{4} Pc + Fk \quad \text{[Formula 6]}$$

When the formula 6 is rearranged by "kpo", the following formula 7 is obtained:

$$kpo = 1 - \frac{Ds^2}{Dp^2} - \frac{4Fk}{\pi * Pc * Dp^2} \quad \text{[Formula 7]}$$

According to the formula 7, "kpo=0.737" is obtained in a case that the piston diameter "Dp" is 3.4 mm, the seat diameter "Ds" is 1.7 mm, the spring load "Fk" is 30N, and the rail pressure "Pc" is 250 MPa.

"Qsub" is decided by a capability of the actuator 60. In other words, "Qsub" can be made larger, as a control-valve closing power for the control valve 63 depending on the actuator 60 becomes larger. Namely, the orifice diameter for the sub out-orifice 23*a* is decided by such a value within a range of the control-valve closing power of the actuator 60 so that the "Qsub" becomes larger as much as possible.

As above, "kpo" is defined by the formula 7 and "Qsub" is decided depending on the capability of the actuator 60. When the values for "kpo" and "Qsub" are substituted in the formula 4, "Qin" can be obtained. Namely, "Qin" can be so decided that the steady pressure coincides with the valve-body opening pressure "PO". Then, the orifice diameters for the sub out-orifice 23*a* and the in-orifice 22*a* can be decided in order to meet the above decided "Qin" and "Qsub".

FIGS. 8A to 8D show results of numerical analyses for a case, in which "Qin/Qsub" is decided in accordance with the formula 4 and the formula 7 and two injection command signals are sequentially outputted to the solenoid coil 61. FIGS. 9A to 9D show results of other numerical analyses for a case, in which "Qin/Qsub" is made larger than the above "Qin/Qsub" by 2.5 (more exactly, "Qin" is made larger than "Qin" of the above case of FIGS. 8A to 8D by 2.5) and the same fuel injections to the case of FIGS. 8A to 8D are carried out. In FIGS. 8A to 8D and 9A to 9D, solid lines show the results of the respective numerical analyses, in which intervals for power supply (intervals for the command signals) to the solenoid coil 61 are changed. In other words, FIGS. 8A to 8D show the results of the numerical analyses for the case, in which the orifice diameters are so decided that the steady pressure is equal to the valve-body opening pressure "PO", while FIGS. 9A to 9D show the results of the numerical analyses for the case, in which the orifice diameters are so decided that the steady pressure is larger than the valve-body opening pressure "PO".

Figure 8A:
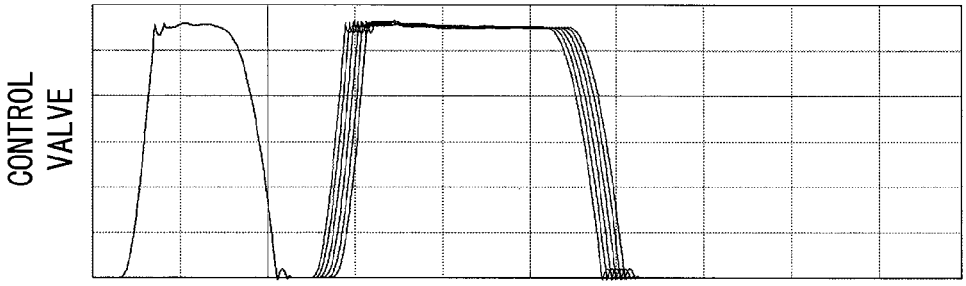
FIGS. 8A to 8D are views showing simulation results for the first embodiment having an interval shortening control portion.
Figure 8B:
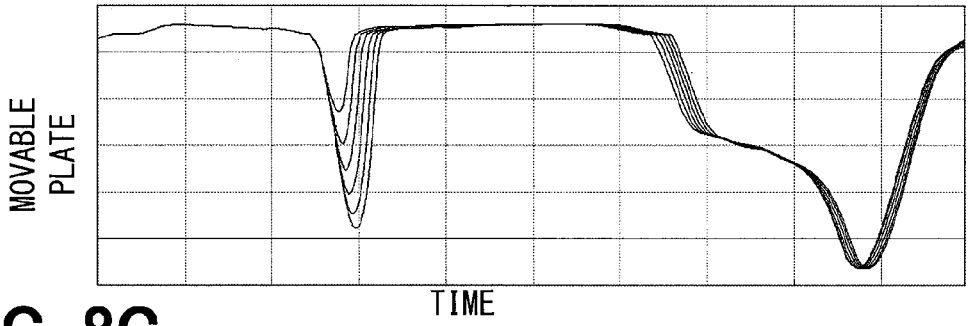
Figure 8C:
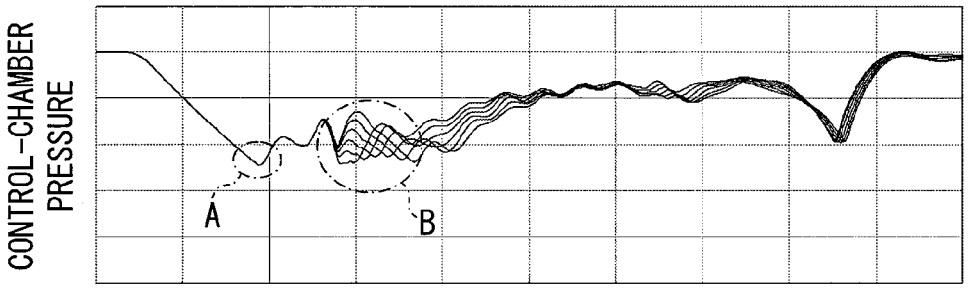
Figure 8D:
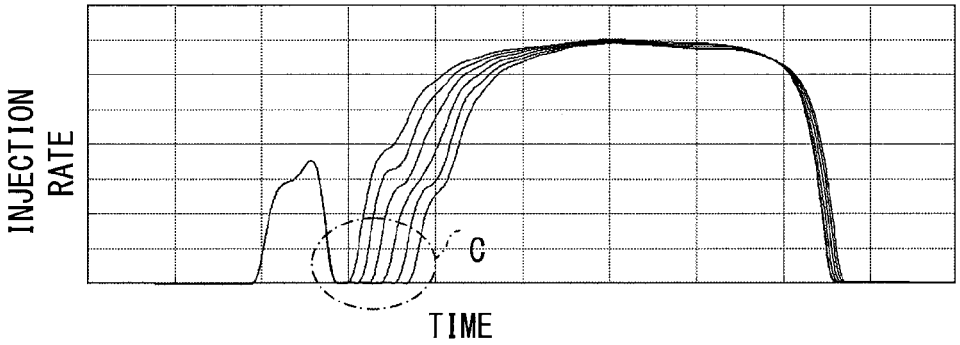

As shown in FIG. 8A, the control valve 63 is sequentially opened twice in accordance with the injection command signals. Then, the movable plate 80 is displaced as shown in FIG. 8B. Namely, the movable plate 80 is separated from the fixed plate 20 when a first opening operation of the control valve 63 is ended in order to terminate the fuel injection, as explained in connection with FIG. 4D. This movement of the movable plate 80 is indicated in FIG. 8B as a first plate movement. FIG. 8C shows changes of the control-chamber pressure "Pcon". As shown in FIG. 8C, the control-chamber pressure "Pcon" is decreased in accordance with the first opening operation of the control valve 63. A one-dot-chain line A in FIG. 8C shows that the control-chamber pressure "Pcon" is decreased to the valve-body opening pressure "PO". As shown in FIG. 8D, the injection rate starts its increase from this time point.

When the control valve 63 is closed at the end of the first opening operation, the movable plate 80 is separated from the fixed plate 20 and starts its downward movement, as shown in FIG. 8B. Then, the injection rate becomes zero to terminate the fuel injection. Thereafter, the control valve 63 is opened again (a second opening operation) at an earlier timing than a timing of the normal control, by the control for shortening the injection interval. The movable plate 80 is moved in the upward direction in accordance with the second opening operation of the control valve 63. During this upward movement of the movable plate 80 (which is still separated from the fixed plate 20), the control-chamber pressure "Pcon" is not increased but remains at around the valve-body opening pressure "PO" as indicated by a one-dot-chain line B in FIG. 8C. Thereafter, when the movable plate 80 is brought into contact with the fixed plate 20, the valve body 50 starts its valve-body opening operation to increase the injection rate, as indicated by a one-dot-chain line C in FIG. 8D.

As above, in the case that "Qin/Qsub" is decided based on the formulas 4 and 7, the pressure increase of the control-chamber pressure "Pcon" is suppressed at the timing immediately before the second valve opening operation of the control valve 63, as indicated by the one-dot-chain line B. As a result, the valve-body opening timing for the second fuel injection is changed, as indicated by the one-dot-chain line C in FIG. 8D, in accordance with an interval command value of the injection command signal.

Figure 9A:
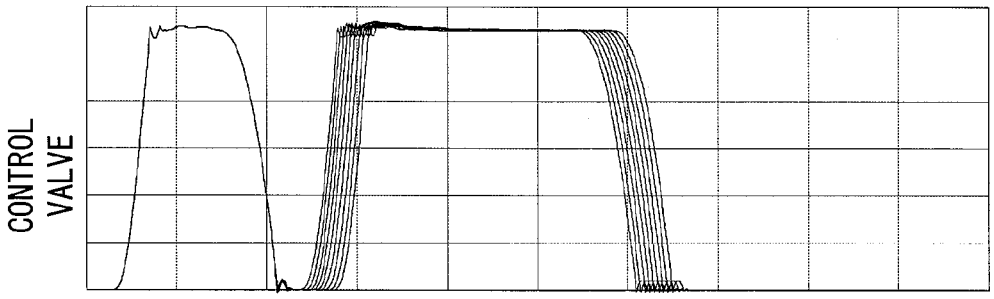
FIGS. 9A to 9D are views showing simulation results for a fuel injection valve having no interval shortening control portion.
Figure 9B:
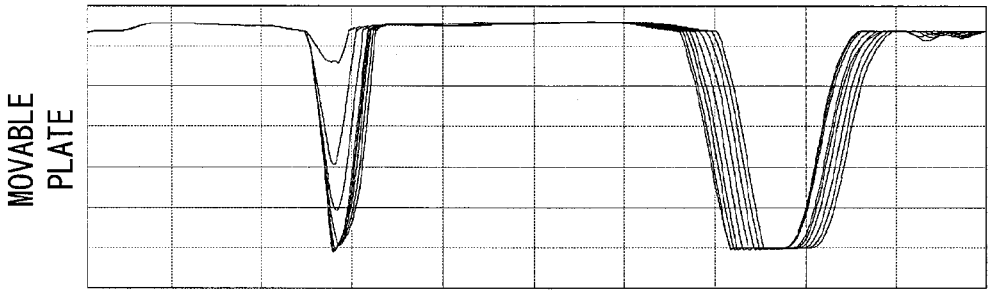
Figure 9C:
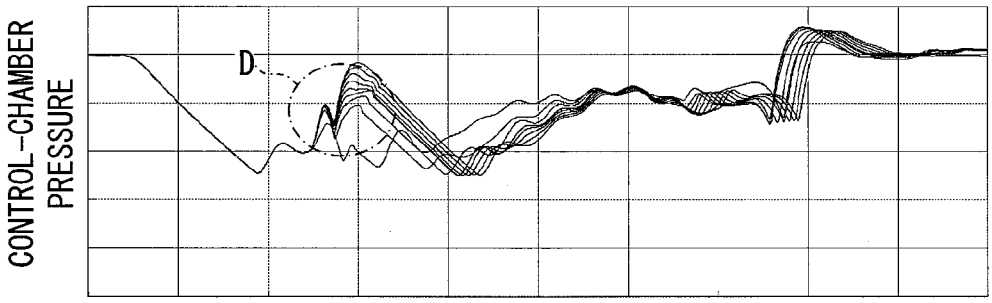
Figure 9D:
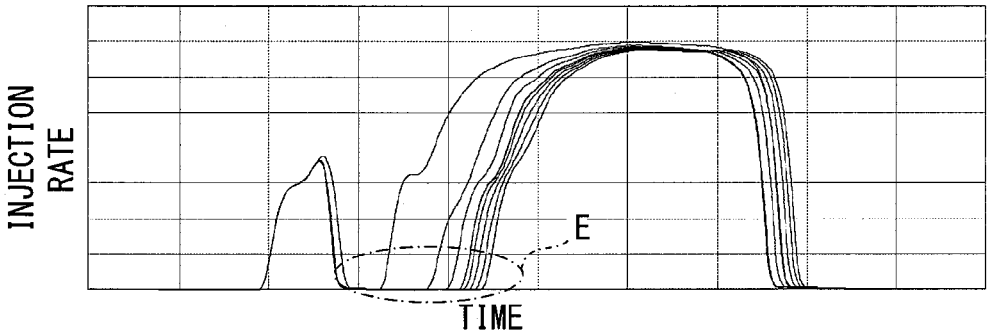

In the case of FIGS. 9A to 9D, in which "Qin/Qsub" is made larger than that in the case of FIGS. 8A to 8D by 2.5, the control-chamber pressure "Pcon" is temporarily increased at the timing immediately before the second valve opening operation of the control valve 63, as indicated by a one-dot-chain line D in FIG. 9C. This is due to the fact that the control valve 63 is closed. Thereafter, when the movable plate 80 is brought into contact with the fixed plate 20, the valve body 50 starts its valve-body opening operation to increase the injection rate, as indicated by a one-dot-chain line E in FIG. 9D. When the commanded interval becomes shorter, it becomes difficult for the valve body 50 to follow the injection command signal. Namely, as shown by the one-dot-chain line E in FIG. 9D, it becomes difficult that the valve-body opening timing is changed in accordance with the injection command signal.

Figure 10:
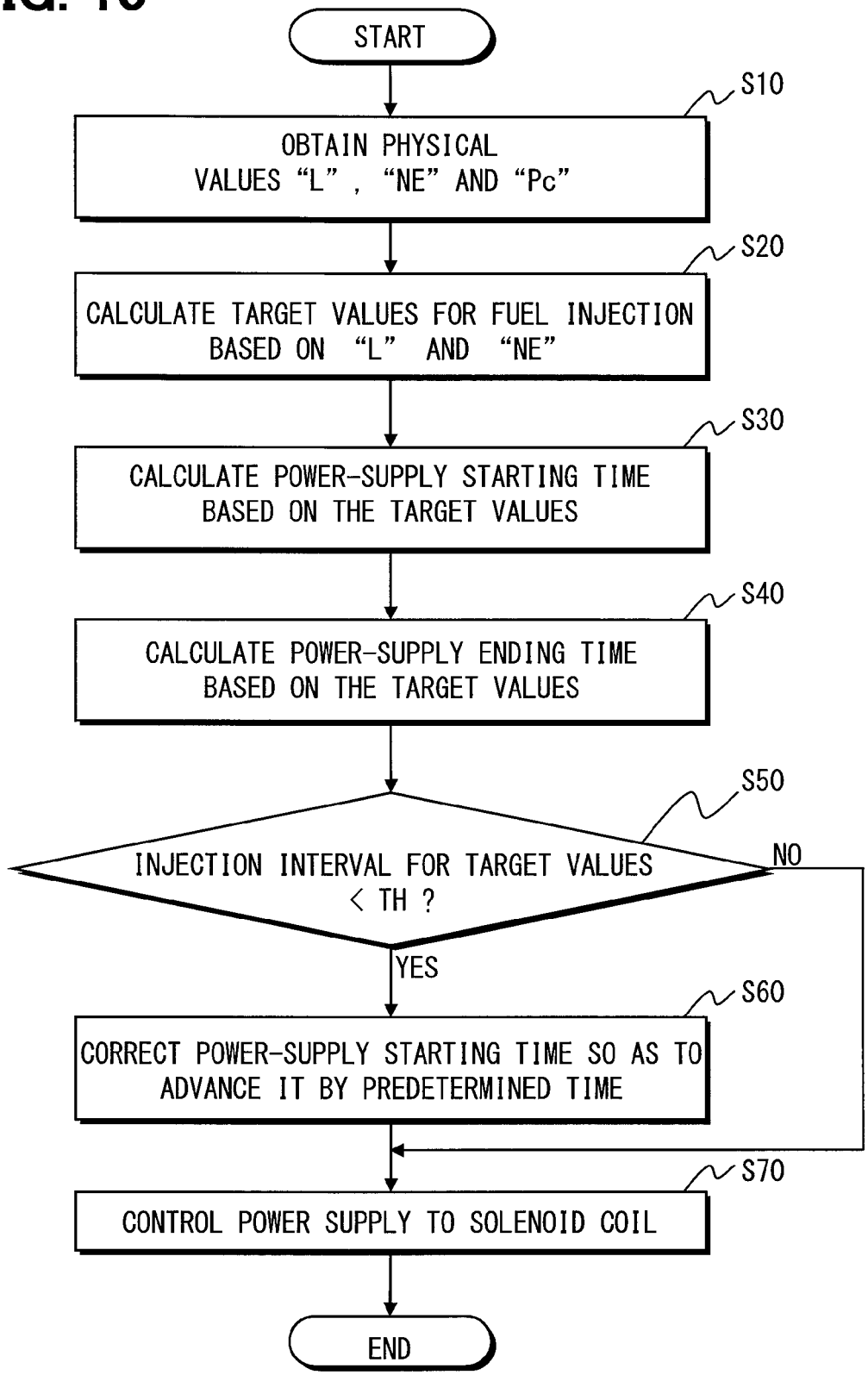
FIG. 10 is a flow-chart showing a process of controlling the fuel injection valve in the first embodiment.

FIG. 10 is a flow-chart showing a process for controlling power supply to the fuel injection valve 1, according to which a micro-computer of the ECU 2 calculates the injection command signal to be supplied to the solenoid coil 61 in order to control the fuel injection from the fuel injection valve 1. The power supply control to the solenoid coil is repeatedly carried out by the micro-computer when an ignition switch (not shown) is turned on.

At first, at a step S10 of FIG. 10, the ECU 2 obtains physical values indicating a current engine operational condition, such as, the engine load "L", the engine rotational speed "NE", the rail pressure "Pc" and so on. A stepping stroke amount of an acceleration pedal, an intake air amount or the like is used as the engine load "L". At a step S20, the ECU 2 calculates target values for the fuel injection based on the engine load "L" and the engine rotational speed "NE" obtained at the step S10. More exactly, the ECU 2 calculates, based on the engine load "L" and the engine rotational speed "NE", a target value for a number of fuel injections (a divided number) to be carried out in one combustion cycle for the same cylinder, a target value for a fuel injection amount and a target value for a fuel-injection starting timing.

At a step S30 (a normal control portion), the ECU 2 calculates a power-supply starting time to the solenoid coil 61, based on the target value for the fuel-injection starting timing obtained at the step S20. Since there exists an injection delay time between a start of the power supply and an actual start of the fuel injection, the ECU 2 calculates the power-supply starting time, which is advanced from the target value for the fuel-injection starting timing by the injection delay time.

At a step S40 (an injection-stop control portion), the ECU 2 calculates a power-supply ending time to the solenoid coil 61, based on the target values for the fuel injection amount and the fuel-injection starting timing, each calculated at the step S20. More exactly, the ECU 2 calculates a power-supply time duration corresponding to the target value for the fuel injection amount and adds such power-supply time duration to the target value for the fuel-injection starting timing. There also exists a delay time between an end of the power supply and an actual end of the fuel injection. Therefore, the ECU 2 calculates the power-supply ending time, which is advanced from the actual end of the fuel injection by such delay time.

At a step S50, the ECU 2 determines whether the injection interval for the target values calculated at the step S20 (that is, the interval of the target values for the fuel-injection starting timings) is smaller than a threshold value "TH". More exactly, a time duration from the target value for the fuel-injection ending timing of a previous injection to the target value for the fuel-injection starting timing of a current injection is calculated as the above injection interval. When the calculated injection interval is smaller than the threshold "TH", namely when YES at the step S50, the process goes to a step S60 (an interval-shortening control portion). The ECU 2 corrects the power-supply starting time (which is calculated at the step S30 by taking into consideration the injection delay time), so as to advance the power-supply starting time by a predetermined time. The predetermined time is set at such a value, with which the control valve 63 starts the control-valve opening operation during a period in which the valve body 50 is carrying out its control-valve closing operation.

At a step S70, the ECU 2 controls the power supply to the solenoid coil 61 in such a manner that the ECU 2 starts the power supply to the solenoid coil 61 at the power-supply starting time which is corrected at the step S60 and stops the power supply at the power-supply ending time calculated at the step S40.

When the calculated injection interval is larger than the threshold "TH" (NO at the step S50), the process goes to the step S70 without carrying out the correction for the power-supply starting time at the step S60. In this case, at the step S70, the ECU 2 controls the power supply to the solenoid coil 61 in such a manner that the ECU 2 starts the power supply to the solenoid coil 61 at the power-supply starting time calculated at the step S30 and stops the power supply at the power-supply ending time calculated at the step S40.

As above, according to the process of FIG. 10, the normal control for the fuel injection is carried out when the injection interval is larger than the threshold "TH" (NO at the step S50). Namely, the ECU 2 starts the power supply at the power-supply starting time, which is calculated based on the target value for the fuel-injection starting timing. In this case, since the injection interval is sufficiently long, the power supply to the solenoid coil 61 is carried out after the movable plate 80 is brought into contact with the fixed plate 20. Then, the control valve 63 is opened to start the fuel injection.

On the other hand, the interval-shortening control for the fuel injection is carried out when the injection interval is smaller than the threshold "TH" (YES at the step S50). In the interval-shortening control, the ECU 2 starts the power supply at the timing earlier than the power-supply starting time, which is calculated (at the step S30) based on the target value for the fuel-injection starting timing. In this case, since the injection interval is shorter, the power supply to the solenoid coil 61 is carried out before the movable plate 80 is brought into contact with the fixed plate 20. Then, the control valve 63 is opened by the power supply of the earlier timing to start the fuel injection.

According to the above structure and operation, the power supply is carried out at the earlier timing in accordance with the interval-shortening control and the control-chamber pressure "Pcon" is decreased before the fuel injection by setting the orifice diameters as explained above. It is, therefore, possible to reduce a limit value for the injection interval, according to which the actual value for the fuel-injection starting timing is controlled in accordance with the target values for the fuel-injection starting timing.

The present embodiment has the following advantages in relation to the following respective features:

(1) First Feature and Advantage:

The orifice diameters for the sub out-orifice 23*a* and the in-orifice 22*a* are so set that the control-chamber pressure "Pcon" is decreased but not to the valve-body opening pressure "PO" for a predetermined period from the opening of the control valve 63 by the interval-shortening control portion (the step S60).

In a case that the "Qin" is set at an extremely small value, it may become a problem that the control-chamber pressure "Pcon" is over-decreased and the control-chamber pressure "Pcon" is decreased to the valve-body opening pressure "PO", when the control valve 63 is opened during the waiting time period for the purpose of decreasing the control-chamber pressure "Pcon". In such a case, the fuel injection is started in spite of the waiting time period. In other words, the fuel injection is carried out at such a timing earlier than the target value for the fuel-injection starting timing.

According to the feature of the present embodiment, which is made in view of the above problem, the orifice diameters for the sub out-orifice 23*a* and the in-orifice 22*a* are so set that the control-chamber pressure "Pcon" is not decreased to the valve-body opening pressure "PO". Therefore, the above problem can be solved.

(2) Second Feature and Advantage:

The ratio "Qin/Qsub" is so decided that the control-chamber pressure "Pcon" (the steady pressure) in the steady-state situation coincides with the valve-body opening pressure "PO". In the steady-state situation, the fuel discharging amount via the sub out-orifice 23*a* and the fuel supplying amount via the in-orifice 22*a* are stable.

According to such feature, certainty for avoiding the above problem (namely, the problem that the pressure "Pcon" becomes equal to the pressure "PO" to thereby start the fuel injection even during the waiting time period) can be improved. In addition, it is possible to make larger a pressure decrease amount of the control-chamber pressure "Pcon" during the waiting time period and to thereby facilitate the reduction of the limit value for the injection interval.

(3) Third Feature and Advantage:

The interval-shortening control portion (the step S60) starts the opening operation of the control valve 63 even during the course of the valve-body closing operation of the valve body 50. According to such a control, since a time period for opening the control valve 63 in the waiting time period becomes longer, a time period for decreasing the control-chamber pressure "Pcon" in the waiting time period becomes longer. It is, therefore, possible to sufficiently decrease the control-chamber pressure "Pcon" immediately before the fuel injection, to thereby further facilitate the shortening of the limit value for the injection interval.

(4) Fourth Feature and Advantage:

According to the present embodiment, the control-valve opening operation for the control valve 63 by the normal control portion (the step S30) is switched to the control-valve opening operation for the control valve 63 by the interval-shortening control portion (the step S60) depending on the target value for the injection interval. In the normal control, the control-valve opening operation is started when the movable plate 80 is in contact with the fixed plate 20, in order that the control-chamber pressure "Pcon" is decreased to open the valve body 50 for the fuel injection.

When the injection interval is sufficiently long, without carrying out the interval-shortening control, the movable plate 80 is already in contact with the fixed plate 20 at the timing for starting the control-valve opening operation for the purpose of starting the fuel injection. In view of this point, the normal control is carried out when the injection interval is sufficiently long, while the valve-body opening operation is switched from the normal control to the interval-shortening control when the injection interval is short. It is, therefore, possible to carry out the interval-shortening control only when it is necessary.

Second Embodiment

In the first embodiment, as shown in FIG. 2, the sub out-orifice 23*a* is formed at a most downstream side of the low pressure passage 23. Namely, the sub out-orifice 23*a* is opened or closed by the control valve 63.

Figure 11:
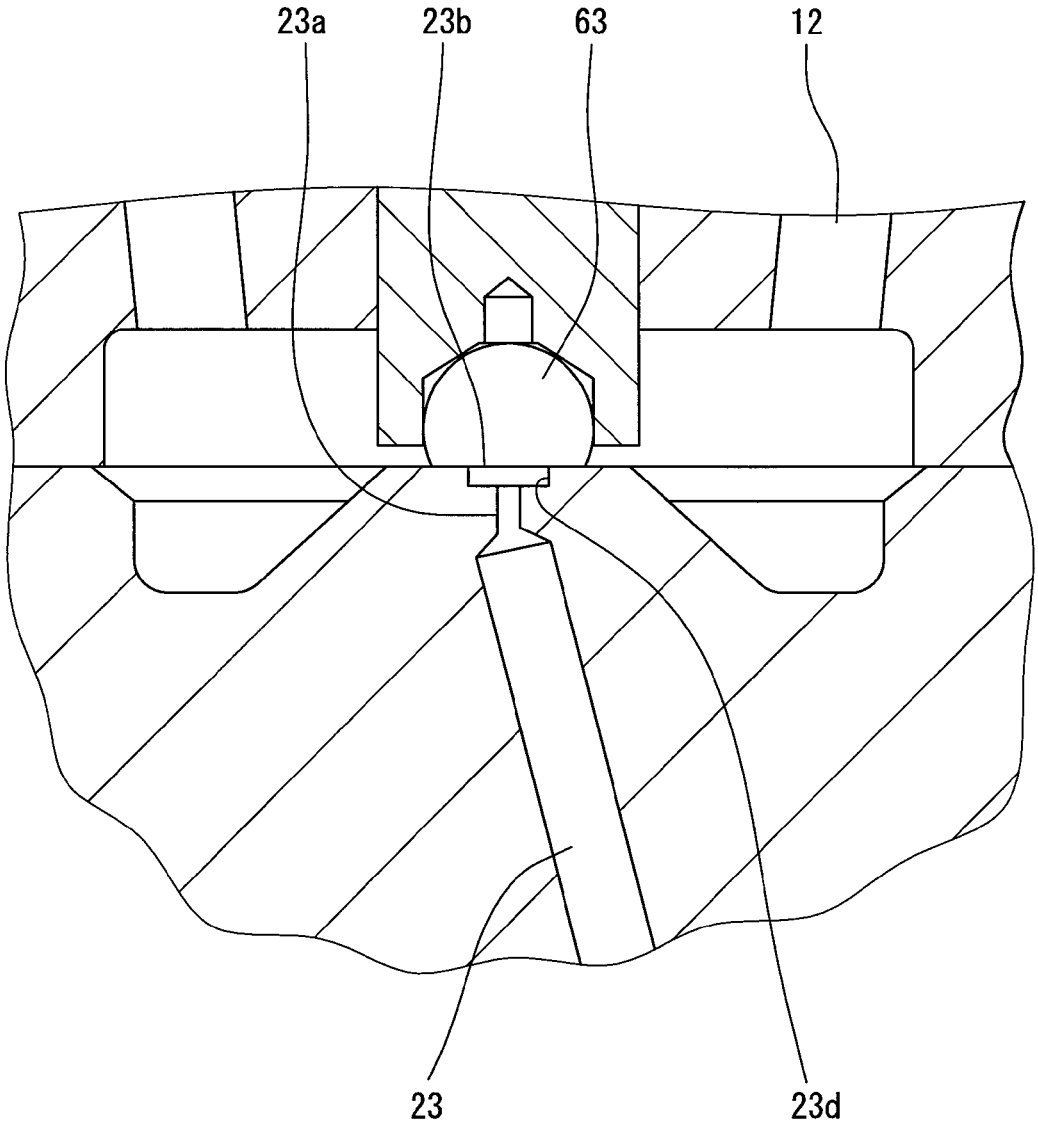
FIG. 11 is a schematic cross sectional view showing relevant portions of a fuel injection valve according to a second embodiment of the present disclosure.

According to the present embodiment, as shown in FIG. 11, a cross sectional area of an outlet port 23*d* of the low pressure passage 23 is made larger than that of the sub out-orifice 23*a*. Accordingly, the outlet port 23*d*, which is formed at the downstream side of the sub out-orifice 23*a*, is opened or closed by the control valve 63.

In the first embodiment of FIG. 2, the flow rate (the fuel discharging amount) restricted by the sub out-orifice 23*a* varies when a distance between the control valve 63 in the opened condition and the sub out-orifice 23*a* is changed. It is not possible to exactly measure the flow rate of the sub out-orifice 23*a* by experiments using the fixed plate 20 by itself. It is only possible to measure the flow rate in the experiments using the fixed plate 20 together with the control valve 63 arranged at the position opposing to the sub out-orifice 23*a*.

In the second embodiment, which is made in view of the above point, the cross sectional area of the outlet port 23*d* can be made sufficiently large. The flow rate of the sub out-orifice 23*a* measured in experiments shows the same value, independently of the distance between the control valve 63 in the opened condition and the outlet port 23*d*. It becomes possible to measure the flow rate of the sub out-orifice 23*a* in the experiments using the fixed plate 20 alone. It is possible to increase productivity for measuring and checking whether the actual value of "Qin/Qsub" is satisfying the value of "Qin/Qsub" calculated based on the formulas 4 and 7.

Third Embodiment

In the first embodiment, the orifice diameters of the sub out-orifice 23*a* and the in-orifice 22*a* are so set that the control-chamber pressure "Pcon" (the steady pressure) in the steady-state situation coincides with the valve-body opening pressure "PO". According to the third embodiment, however, the orifice diameters of the sub out-orifice 23*a* and the in-orifice 22*a* are so set that a difference between the steady pressure and the valve-body opening pressure "PO" is within a predetermined range.

More exactly, the value of "Qin/Qsub" is set to be within a range of plus or minus 30% of the ratio "Qin/Qsub" calculated based on the formulas 4 and 7.

Orifice diameters of the out-orifice 81*a* and the sub out-orifice 23*a* are so set that the flow rate "Qout" of the out-orifice 81*a* is made smaller than the flow rate "Qsub" of the sub out-orifice 23*a*. More preferably, the orifice diameters of the out-orifice 81*a* and the sub out-orifice 23*a* are so set that the flow rate "Qout" of the out-orifice 81*a* is made to be smaller than two thirds of "Qsub".

Further Embodiments and/or Modifications

The present disclosure should not be limited to the above embodiments but can be modified in various manners as below. In addition, the features of the respective embodiments can be optionally combined with one another.

In the above first embodiment, the control-valve opening timing for the control valve 63 is advanced by the predetermined time when the interval-shortening control is carried out, in order that the control-valve opening operation for the control valve 63 is started during the course that the valve body 50 is being moved to the valve-body closing position. However, the above predetermined time may be so set that the control-valve opening operation for the control valve 63 is started after the valve body 50 has been moved to the valve-body closing position.

In the above embodiment shown in FIG. 5, the spring SP2 is provided at the lower end surface of the movable plate 80. As shown in FIGS. 2 and 3, however, the spring SP2 is not always necessary.

In the above first embodiment, when the power-supply starting time is corrected at the step S60 so that the power-supply starting time is advanced by the predetermined time. However, the predetermined time can be changed. For example, the predetermined time can be changed depending on the rail pressure "Pc".

In the above first embodiment, the orifice diameters of the sub out-orifice 23*a* and the in-orifice 22*a* are so decided that the flow rates of "Qsub" and "Qin" meet the formulas 4 and 7. Alternatively, lengths of the sub out-orifice 23*a* and the in-orifice 22*a* are so decided that the flow rates of "Qsub" and "Qin" meet the formulas 4 and 7.

What is claimed is:

1. A fuel injection valve for a fuel injection system of an internal combustion engine comprising:

a valve body movably accommodated in a nozzle body and configured to open and close an injection port;

a pressure control chamber configured to apply control-chamber pressure to the valve body in a valve-body closing direction;

a fixed plate having a high pressure passage configured to supply high pressure fuel to the pressure control chamber so as to move the valve body in the valve-body closing direction, the fixed plate having a low pressure passage configured to discharge fuel out of the pressure control chamber so as to move the valve body in a valve-body opening direction;

a sub out-orifice formed in the low pressure passage configured to restrict flow rate of the fuel discharged from the pressure control chamber;

an in-orifice formed in the high pressure passage configured to restrict flow rate of the fuel supplied into the pressure control chamber;

a movable plate movably accommodated in the pressure control chamber, the movable plate being configured to be brought into contact with the fixed plate so as to block off communication between the high pressure passage and the pressure control chamber or the movable plate being configured to be separated from the fixed plate so as to communicate the high pressure passage to the pressure control chamber, and the movable plate having a through-hole configured to communicate the pressure control chamber to the low pressure passage;

a control valve configured to open and close an outlet port of the low pressure passage; and an electric actuator configured to open the control valve when electric power is supplied to the electric actuator, wherein the fuel injection system has an electronic control unit configured to control power supply to the electric actuator in order to carry out multiple fuel injections for each combustion cycle of the internal combustion engine, and the electronic control unit comprises:

an injection-stop control portion configured to control a control-valve closing operation of the control valve in order to increase the control-chamber pressure and to thereby move the valve body to a valve-body closing position, so that a first fuel injection is terminated; and an interval-shortening control portion configured to start a control-valve opening operation of the control valve even in a condition that the movable plate is still being separated from the fixed plate, when the control-chamber pressure is decreased in order to open the valve body so that a second fuel injection is carried out after the first fuel injection in the same combustion cycle of the internal combustion engine, wherein flow rate of the sub out-orifice and flow rate of the in-orifice are so set that the control-chamber pressure is decreased when the control valve starts the control-valve opening operation for the second fuel injection by the interval-shortening control portion, the flow rate of the sub out-orifice and the flow rate of the in-orifice are so set that a pressure difference between a steady pressure and a valve-body opening pressure is controlled at a value within a predetermined range, the steady pressure is a pressure of the pressure control chamber in a steady-state situation in which a fuel discharging amount via the sub out-orifice and a fuel supplying amount via the in-orifice are stable, the valve-body opening pressure is a pressure of the pressure control chamber at which the valve body starts a valve-body opening operation, and the interval-shortening control portion starts the control-valve opening operation of the control valve for the second fuel injection during a course in which the valve body is in its valve-body closing operation.

2. The fuel injection valve according to claim 1, wherein the flow rate of the sub out-orifice and the flow rate of the in-orifice are so set that the control-chamber pressure is not decreased to a valve-body opening pressure during a predetermined time period from a timing at which the control valve starts the control-valve opening operation by the interval-shortening control portion, wherein the valve-body opening pressure is a pressure of the pressure control chamber, at which the valve body starts a valve-body opening operation.

3. The fuel injection valve according to claim 1, wherein the flow rate of the sub out-orifice and the flow rate of the in-orifice are so set that the steady pressure coincides with the valve-body opening pressure.

4. The fuel injection valve according to claim 1, wherein a cross sectional area of an outlet port of the low pressure passage is made larger than that of the sub-out-orifice.

5. The fuel injection valve according to claim 1, wherein the electronic control unit has a normal control portion for starting the control-valve opening operation of the control valve in a condition that the movable plate is in contact with the fixed plate, so as to carry out fuel injection by decreasing the control-chamber pressure and thereby opening the valve body, and the electronic control unit switches the control-valve opening operation by the normal control portion to the control-valve opening operation by the interval-shortening control portion, depending on a target value of a fuel injection interval.

* * * * *